US008137253B2

(12) United States Patent
Chiu et al.

(10) Patent No.: US 8,137,253 B2
(45) Date of Patent: Mar. 20, 2012

(54) AUTOMATIC BAG HANDLING SYSTEM FOR PRECISELY SECURING A PLASTIC HANDLE TO A PLASTIC BAG

(75) Inventors: Manuel Chiu, Oakville (CA); Robert Lauzon, Montreal (CA); Malcolm Spenceley, Calgary (CA); Ken McLaughlin, St. Thomas (CA); Laurens Vanpagee, Vineland Stations (CA); Slaven Nedic, Toronto (CA); Chris Latour, London (CA); Brent Bell, Oakville (CA); Chris Girard, London (CA); Christine Burns, London (CA); Craig Courteau, St. Catherines (CA)

(73) Assignee: Hood Packaging Corporation, Burlington, Ontario (CA)

( * ) Notice: Subject to any disclaimer, the term of this patent is extended or adjusted under 35 U.S.C. 154(b) by 287 days.

(21) Appl. No.: 12/494,710

(22) Filed: Jun. 30, 2009

(65) Prior Publication Data

US 2010/0331159 A1 Dec. 30, 2010

(51) Int. Cl.
*B31B 1/86* (2006.01)

(52) U.S. Cl. ..... 493/226; 493/221; 493/88

(58) Field of Classification Search ..... 493/226, 493/227, 221, 206, 204, 88
See application file for complete search history.

(56) References Cited

U.S. PATENT DOCUMENTS

| | | | | |
|---|---|---|---|---|
| 3,827,928 | A * | 8/1974 | Gent | 156/423 |
| 3,861,983 | A * | 1/1975 | Harrell | 156/361 |
| 5,363,966 | A * | 11/1994 | Czech et al. | 206/554 |
| 5,495,707 | A * | 3/1996 | Lauzon | 53/572 |
| 6,106,448 | A * | 8/2000 | Obara et al. | 493/11 |
| 6,135,938 | A * | 10/2000 | Discacciati et al. | 493/194 |
| 6,557,695 | B2 * | 5/2003 | Gerber et al. | 198/473.1 |
| 7,191,576 | B2 * | 3/2007 | Talou | 53/413 |

* cited by examiner

*Primary Examiner* — Sameh H. Tawfik
(74) *Attorney, Agent, or Firm* — Norton Rose Canada LLP

(57) ABSTRACT

An automatic handle attaching system and method for precisely securing a plastic handle on an edge of a preformed plastic bag is described. The system comprises a delivery conveyor for conveying spaced-apart groups of flat plastic bags with each group having two or more bags disposed one on top of the other and offset along a leading straight edge thereof which is oriented approximately transverse to a conveying direction of a conveyor. Two or more automated bag handling mechanisms are disposed spaced-apart adjacent the conveyor at respective bag transfer stations. Each of the bag handling mechanisms are independently operated and have an orientable bag engaging hand secured to an articulated arm. The bag handling mechanisms are independently controlled by a controller whereby to orient the bag engaging hand in alignment with a top one of the groups of bags at its transfer station and to transfer the bag to a handle securing station where the bag is precisely positioned with respect to a handle which is then welded thereto. After the handle is welded its relationship with respect to other parts of the bag is verified and the bag with the handle is then transferred to a magazine for accumulation to form bag bundles which are then automatically transferred for bundle securement and shipping.

20 Claims, 12 Drawing Sheets

AUTOMATIC BAG HANDLING SYSTEM FOR PRECISELY SECURING A PLASTIC HANDLE TO A PLASTIC BAG

TECHNICAL FIELD

The present invention relates to a computer controlled automated bag handling system and method for precisely securing a plastic handle to a plastic bag.

BACKGROUND ART

It is known to secure all sorts of handles to different sizes of bags either manually, semi-automatically or fully automatically. However, these systems and methods are not precise, are slow due to the fact that they are on-line systems along which, repetitive functions are performed. If one of the functions experiences a malfunction, then the entire assembly line is stopped and this results in added cost and all sorts of other problems. Also, these automated or semi-automated systems require manual loading of bags and slow handle attaching processes. The packaging of the bags is also labour intensive.

With some specialty plastic bags it is required to secure a handle at a very precise location along an edge of the bag. This is particularly the case with heavy-duty plastic bags provided with a perforated tear spout in a corner area of the bag to dispense heavy material therefrom such as salt pellets, or other granular products. Such a bag is disclosed in our pending U.S. patent application entitled "Heavy-Duty Plastic Bag With Easy Tear Corner Spout Portion" and bearing Ser. No. 12/222,934 filed on Aug. 20, 2008.

SUMMARY OF INVENTION

It is therefore a feature of the present invention to provide an automatic bag handling system and method for precisely attaching a plastic handle to a plastic bag and which substantially overcomes all of the above-mentioned disadvantages of the prior art.

Another feature of the present invention is to provide an automatic handle attaching system for securing a plastic handle along an edge of a bag, which edge is also provided with a perforated tear spout in a corner area of the edge to which the handle is secured.

Another feature of the present invention is to provide an automatic handle attaching system which is computer controlled and capable of automatically supplying bags, handling the bag to weld the handle thereto at a precise location, to transfer the bag with the handle to a group forming station to form a bag bundle and to secure the bundle for shipping at a further station.

Another feature of the present invention is to provide an automatic handle attaching system including an automated bag handling mechanism which is computer-controlled and capable of picking up a top bag from a group of offset bags and which bag may be out of alignment and transfer same while re-orienting the bag to a precise location in an ultrasonic welding device.

Another feature of the present invention is to provide a method of attaching a plastic handle at a precise location on an edge of a preformed plastic bag which is transferred from a conveyor while the conveyor is in movement and transferring and re-orienting the bag to a handle securing station for welding the handle thereto.

Another feature of the present invention is to provide an automatic handle attaching system capable of inspecting the bags during handling to reject and remove bags of inferior quality during the process.

According to the above features, from a broad aspect, the present invention provides an automatic handle attaching system for precisely securing a plastic handle on an edge of a preformed plastic bag. The system comprises a delivery conveyor for conveying spaced-apart groups of flat plastic bags. Each group of bags has two or more bags disposed one on top of the other and offset along a leading straight edge thereof which is oriented approximately transverse to a conveying direction of the delivery conveyor. Two or more automated bag handling mechanisms are disposed spaced-apart adjacent the delivery conveyor at respective bag transfer stations. Each bag handling mechanism is independently operated and has an orientable bag engaging hand secured to an articulated arm. Detection means is provided at each of the bag transfer stations to detect the orientation and position of a top one of the bags of one of the groups at the bag transfer stations. Control means is provided to position the bag engaging hand to engage the top one of the bags at its associated bag transfer station as the groups of bags are conveyed by the conveyor. The articulated arm displaces the bag engaging hand to precisely position the leading straight edge of the bag at a precise location at a handle securing station having bag position detection means and handle attachment means. Means is also provided to transfer the bag with the handle secured thereto and to position a further handle in the handle attachment means at the handle securing station.

According to a further broad aspect of the present invention there is provided a method of attaching a plastic handle at a precise location on an edge of a preformed plastic bag. The method comprises the steps of conveying on a delivery conveyor a plurality of spaced-apart groups of the plastic bags. Each group contains a predetermined number of bags in a flat form disposed one on top of the other and offset along a leading straight edge thereof. The straight edges of the bags are oriented approximately transverse to a conveying direction of the delivery conveyor. The method further comprises detecting the orientation and position of a top one of the bags as they are conveyed at at least two bag transfer stations and wherein the bags may have been subjected to slight displacement. The method further comprises engaging the top one of the bags by a bag engaging hand oriented by a controller to coincide with the detected orientation and position of the top one of the bags. The method further comprises transferring the engaged top one of the bags to a handle securing station with the leading straight edge thereof disposed at a precise location relative to the plastic handle retained at the handle securing station. The handle is then secured onto the bag at the precise location. The bag with the welded handle is then transferred away from the handle securing station for further processing. The method further comprises positioning a further handle at the handle securing station to receive a further top one of a following group of the groups of bags conveyed at the bag transfer station. The groups of bags are conveyed in an uninterrupted manner through the bag transfer station.

BRIEF DESCRIPTION OF DRAWINGS

A preferred embodiment of the present invention will now be described with reference to the accompanying drawings in which.

DESCRIPTION OF PREFERRED EMBODIMENTS

Figure 4:
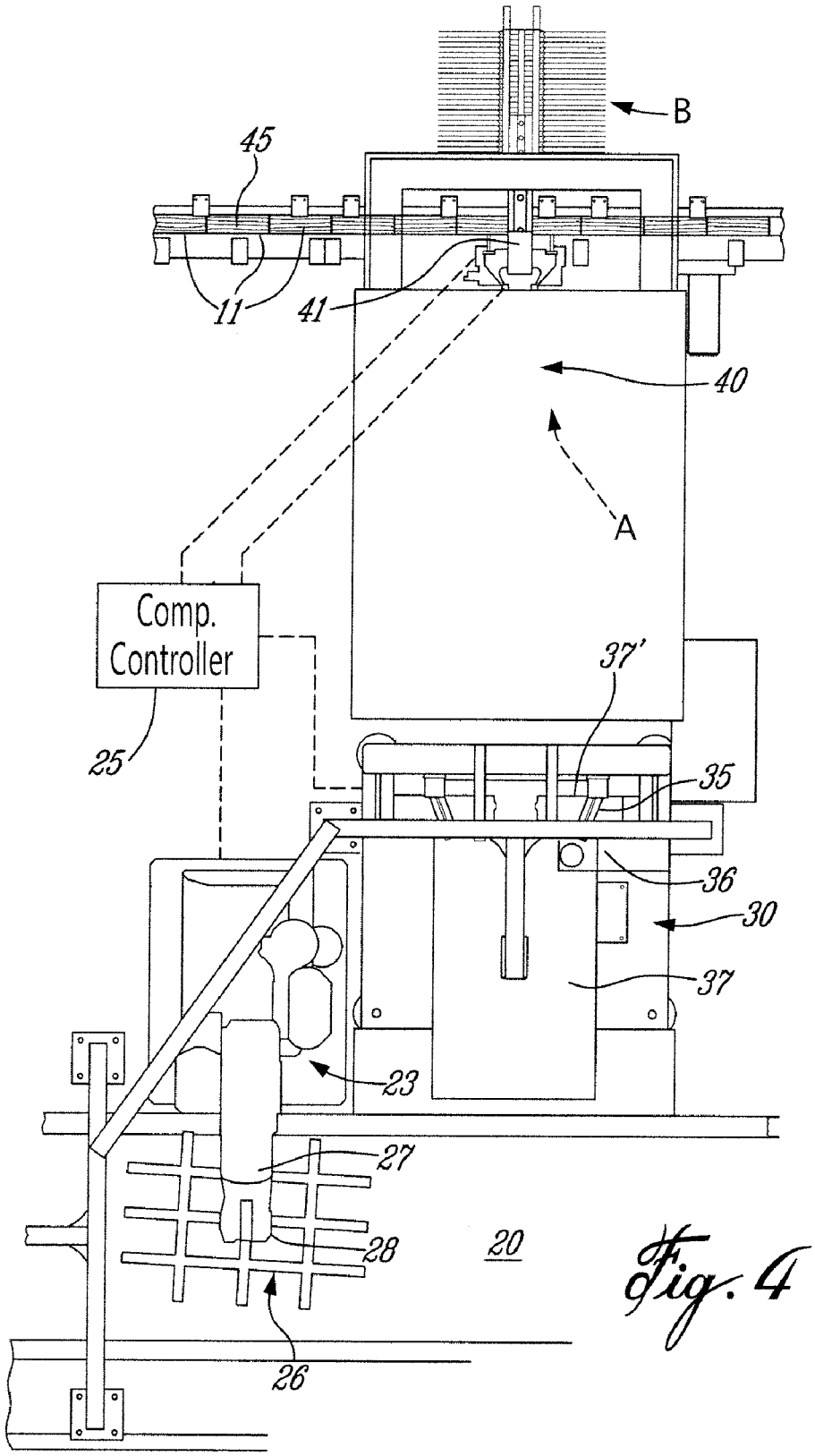
FIG. 4 is a top view of the automated bag handling mechanism, herein a computer-controlled robot and illustrating its relationship with respect to a feed conveyor, a handle securing station and a bag bundle retrieving and transporting mechanism.
Figure 5:
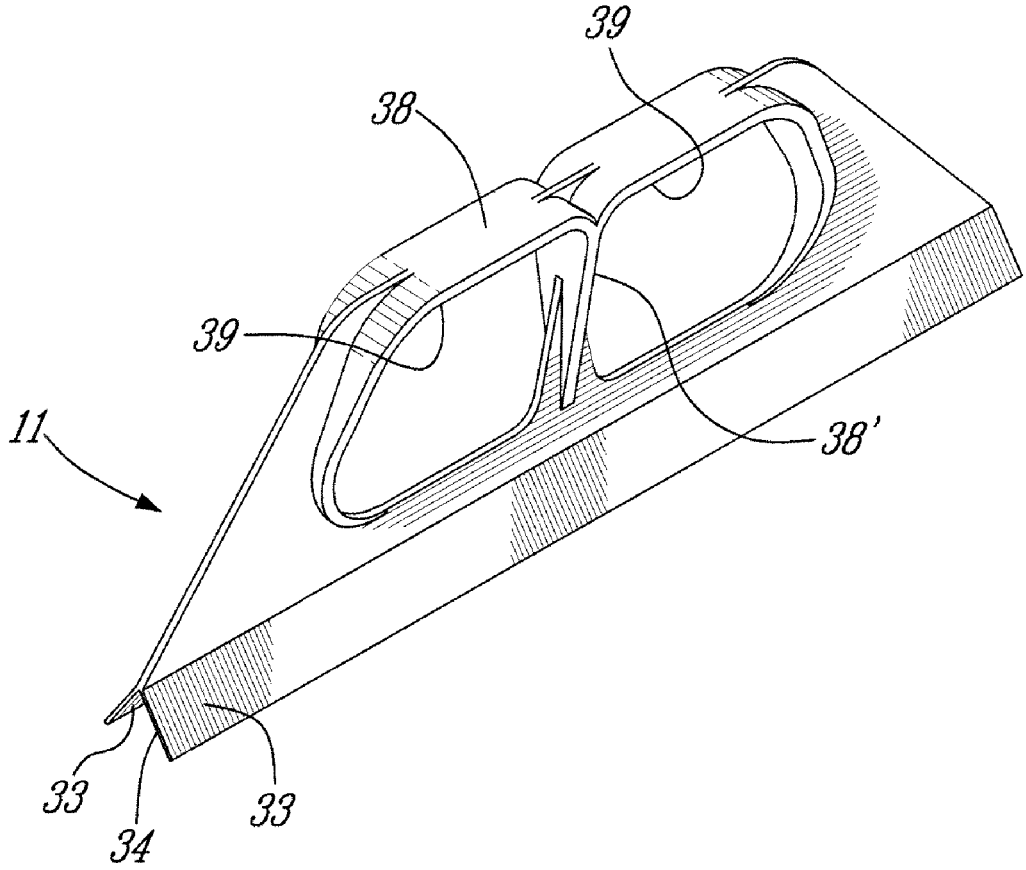
FIG. 5 is a perspective view of a plastic handle adapted for securement to a top edge of a plastic bag.
Figure 6:
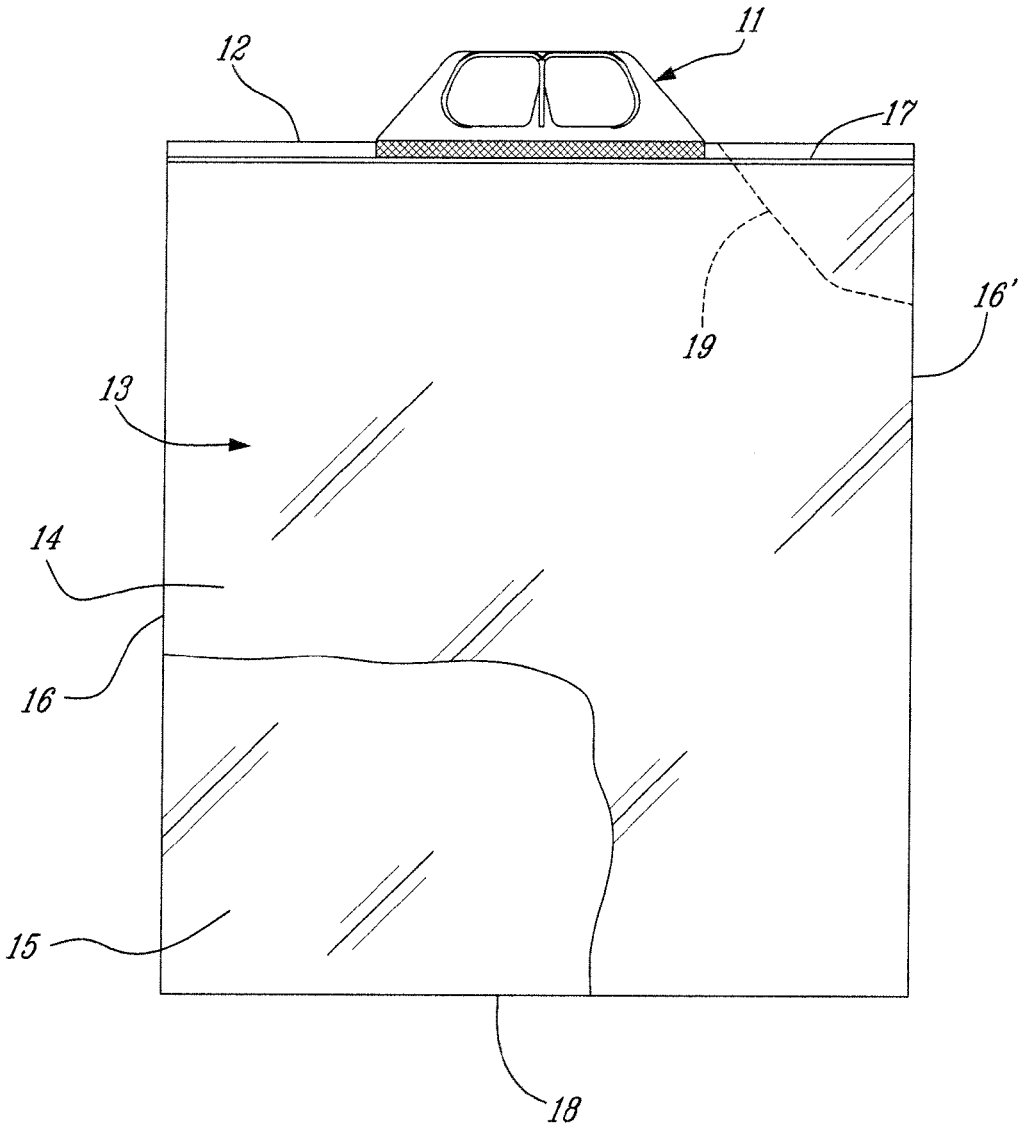
FIG. 6 is a plan view, partly fragmented, of a plastic bag having the handle secured thereto.

Referring now to the drawings and more specifically to FIGS. 1 to 4, there is shown generally at 10 the automatic handle attaching system of the present invention for precisely securing a plastic handle 11, as shown in FIG. 5, to an edge 12 of a plastic bag 13, as shown in FIG. 6. The plastic bag 13 is formed by a bag forming machine and comprises a front wall 14 and a rear wall 15 interconnected at opposed side edges 16 and 16'. The top open end of the bag is sealed by a seal line 17 and the bottom end 18 of the bag is open for later inserting a product therein. A perforated spout profile 19 is formed by perforations in a corner of the sealed end of the bag. The automatic handle attaching system 10 of the present invention secures the handle 11 substantially centrally on the top edge 12 of the plastic bag 13 and spaced a predetermined distance from the perforated spout profile 19.

Figure 1:
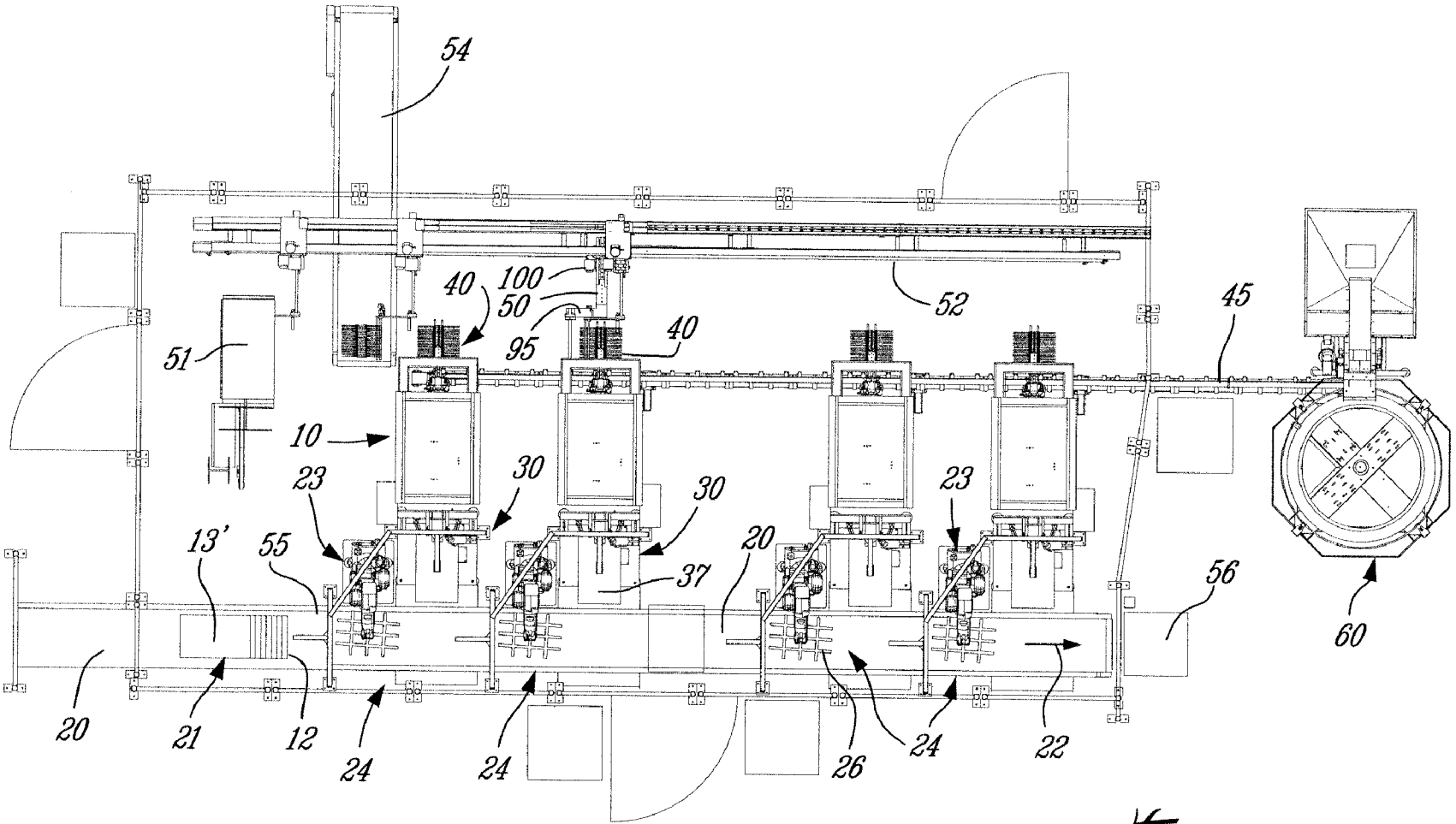
FIG. 1 is a top view of the automatic handle attaching system of the present invention.

Referring to FIGS. 1 to 4, the automatic handle attaching system 10 comprises a delivery conveyor 20 for conveying spaced-apart groups 21 of the plastic bags 13. As shown in FIG. 1, each group 21 has two or more bags disposed one on top of the other and offset along a leading straight edge which is the edge 12 of the bag as shown in FIG. 6. More specifically, in the illustrated embodiment, each group 21 is comprised of four flat plastic bags disposed offset one on top of each other. As also hereinshown, the bags are oriented whereby the leading straight edge 12 is disposed approximately transverse to the conveying direction, as indicated by arrow 22 of the delivery conveyor.

Two or more automated bag handling mechanisms 23, herein four of such mechanisms 23 constituted by robots, are disposed spaced-apart adjacent the conveyor 20 at respective bag transfer stations 24. As better shown in FIG. 4, each of the bag handling mechanisms, namely the robots 23, are independently operated by a control means, herein a computer controlled controller 25. Each robot 23 has an orientable bag engaging hand 26 secured to an articulated arm 27.

Figure 2:
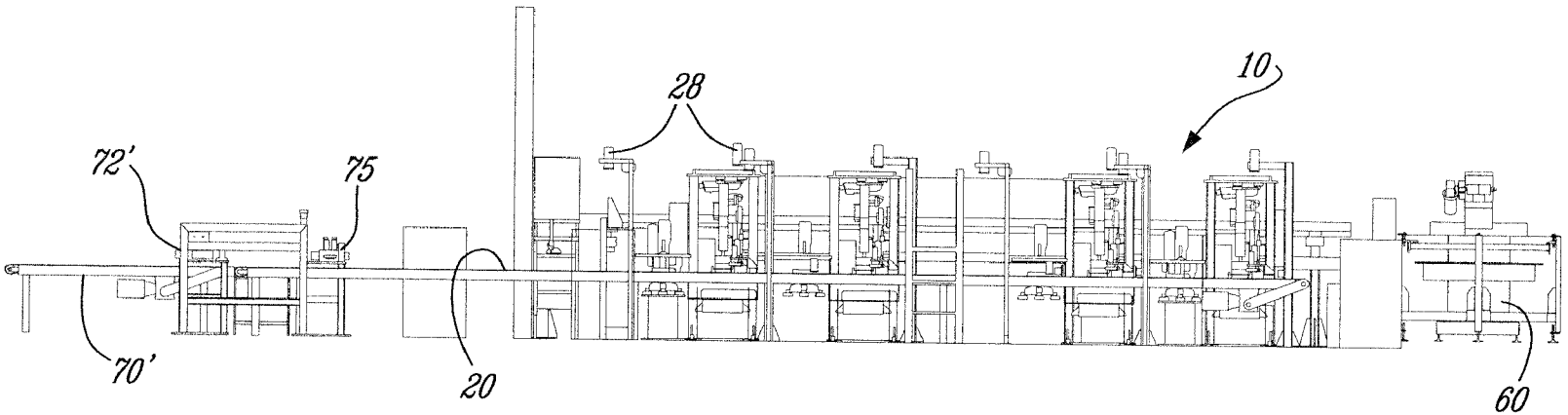
FIG. 2 is a side view of FIG. 1.
Figure 3:
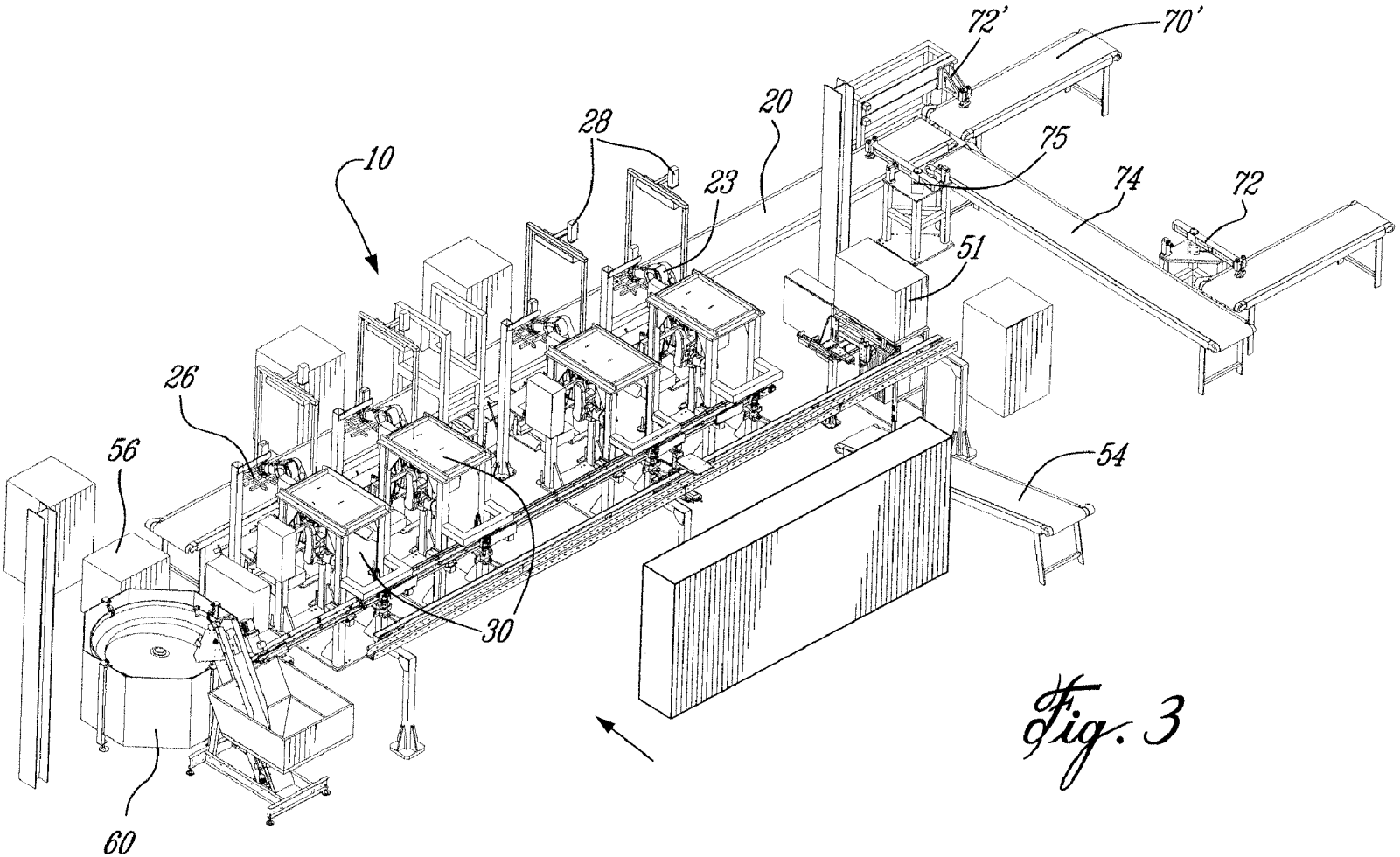
FIG. 3 is a perspective rear view of the automatic handle attaching system of the present invention.

Detection means in the form of cameras 28, as shown in FIG. 2, are disposed at a precise elevated position at each of the transfer stations 24 whereby to detect the precise orientation and position of a top bag of the groups of bags 13, namely bag 13' as shown in FIG. 1 and to feed video signal data to the controller 25. The controller 25 is a programmable controller having a computer provided with a memory in which are stored executable instructions. The computer analyzes the video signal data which indicates the position and orientation of the top one of the bags, namely bag 13', inside a predefined perimeter area, as stored in the memory of the computer, and causes the articulated arm 27 of the robot 23 and the bag engaging hand 26 to orient itself in conformity with the orientation of the top bag 13'. The bag engaging hand 27 is thus positioned to engage a top one of the bags as the groups of bags 21 continue to be conveyed by the delivery conveyor 20 at its associated bag transfer station 24. It is pointed out that the delivery conveyor 20 is in constant movement and its speed is controlled by the controller 25 in synchronism with the other devices of the system. The bag engaging hand 26 is provided with suction cups to pick up the top bag 23', as will be described later, and the articulated arm transfers the hand 26 and the top bag 13' to a handle securing station 30.

Figure 7A:
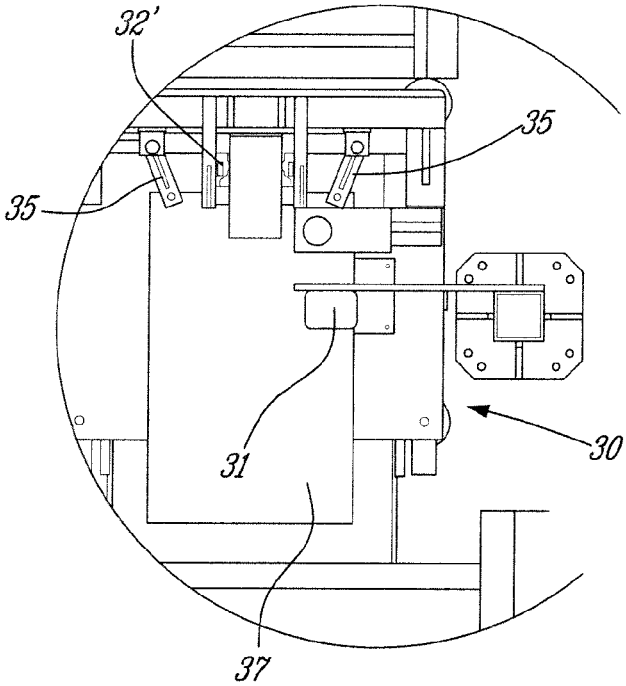
FIG. 7A is a top view of the handle securing station.
Figure 7B:
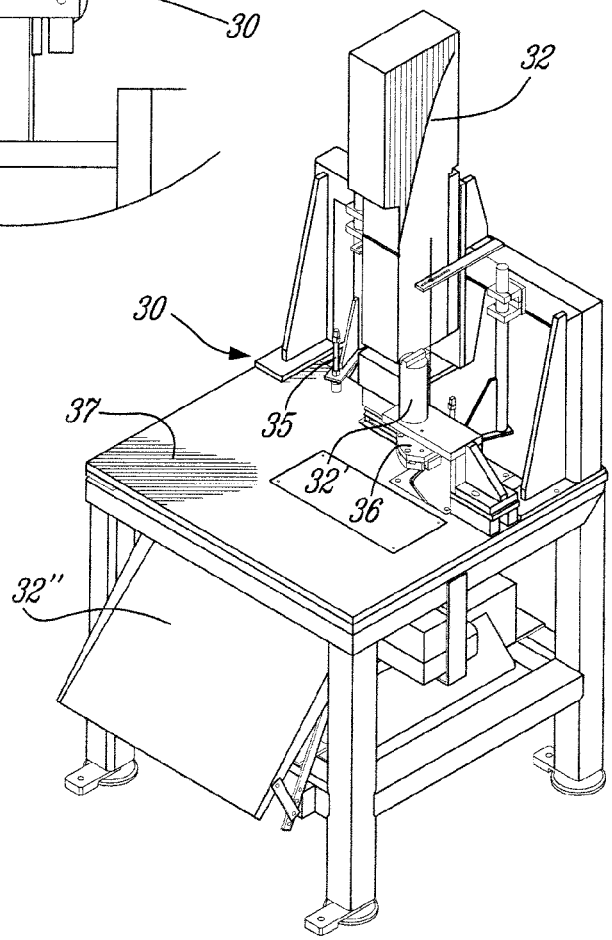
FIG. 7B is a perspective view of the handle securing station.

As better shown in FIGS. 7A and 7B, the handle securing station 30 is provided with bag detection means, herein a further fine-tuning camera 31 secured at an elevated position over the handle securing station 30. A handle attachment means in the form of an ultrasonic welding jaw or horn, of an ultrasonic welder device 32, is also provided. The handle 11 is provided with an attachment portion or channel 34 formed by angulated lower flaps 33 angulated outwards from one another whereby to define the attachment channel 34 therebetween, as shown in FIG. 5. The handle 11 is retained in a nest 32' precisely positioned at the end edge 37' of the table 37 with respect to the ultrasonic welding horn whereby to receive a top edge portion of the plastic bag 13' in between the open flaps 33. The camera 31 fine tunes the positioning of the top leading edge 12 of the bag and feeds video signal data to the controller whereby it precisely aligns the bag with respect to the nest in which the handle is positioned. Once the top edge of the bag is in position within the flaps 33 of the handle, clamps 35 are actuated to clamp the bag in position. The ultrasonic welding horn 32 is then closed and the handle is ultrasonically welded to the top edge of the bag. A sensor, not shown, verifies the position of the handle with respect to the corner of the bag in which the perforated spout profile is formed and if within tolerances, as programmed with the memory of the controller, will send an acceptance signal to the controller to accept the bag. If outside these tolerances the bag will be rejected in a fashion as will be described later.

As also additionally shown in FIG. 4, the handle securing station has a bag support table 37, as above-mentioned, on which the bag is laid down during its positioning in the welding assembly. If a bag is to be rejected because the handle is improperly secured, the articulated arm moves the bag engaging hand 26 to an angulated forward position in front of the table 37 where there is provided a bin or chute 32", see FIG. 7B, to receive rejected bags for recycling. A perforated tool 36 perforates the spout profile 19 if necessary, if the bag spout is not pre-perforated.

Figure 8:
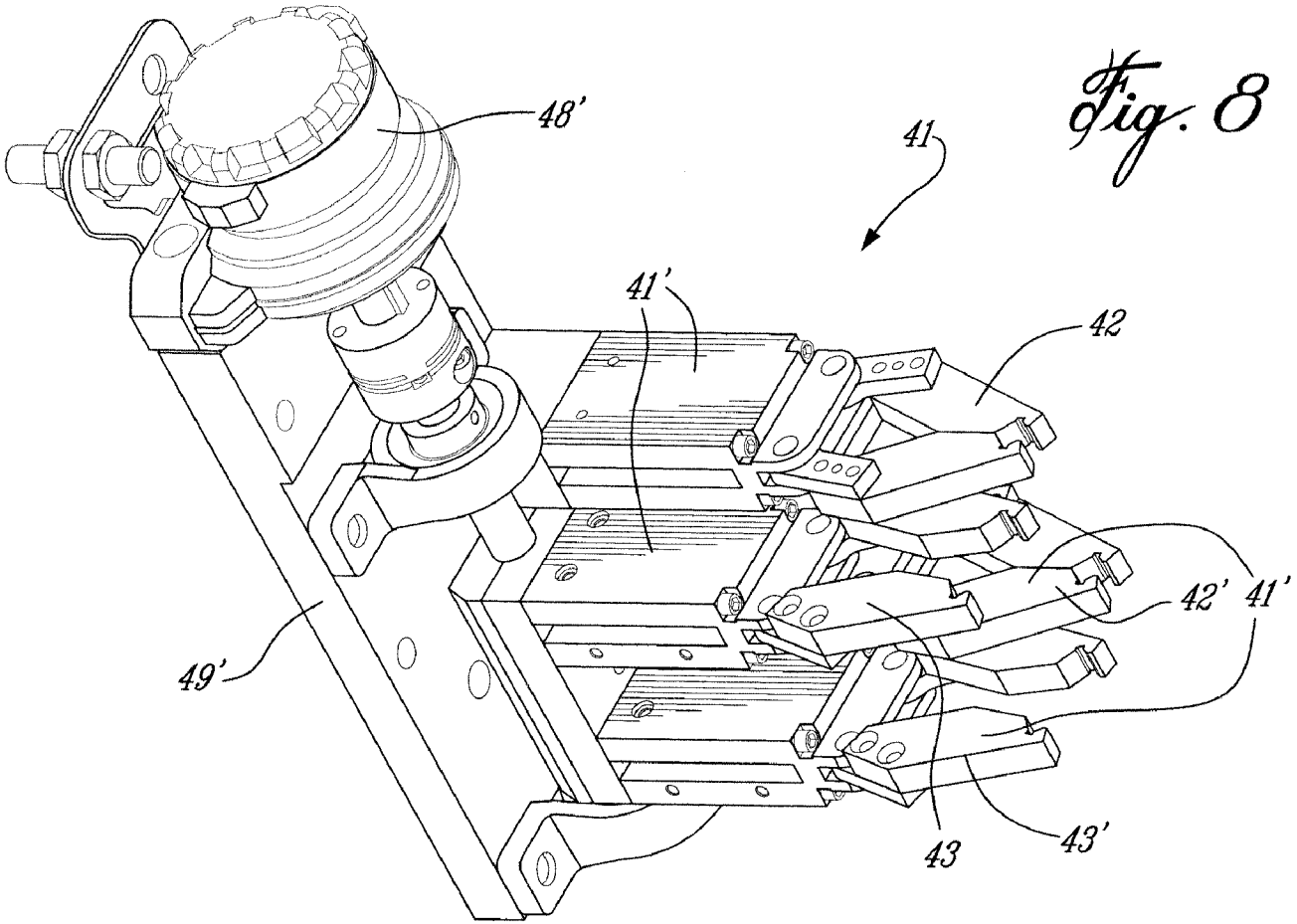
FIG. 8 is a perspective view of the motorized hand gripping transfer assembly.
Figure 10:
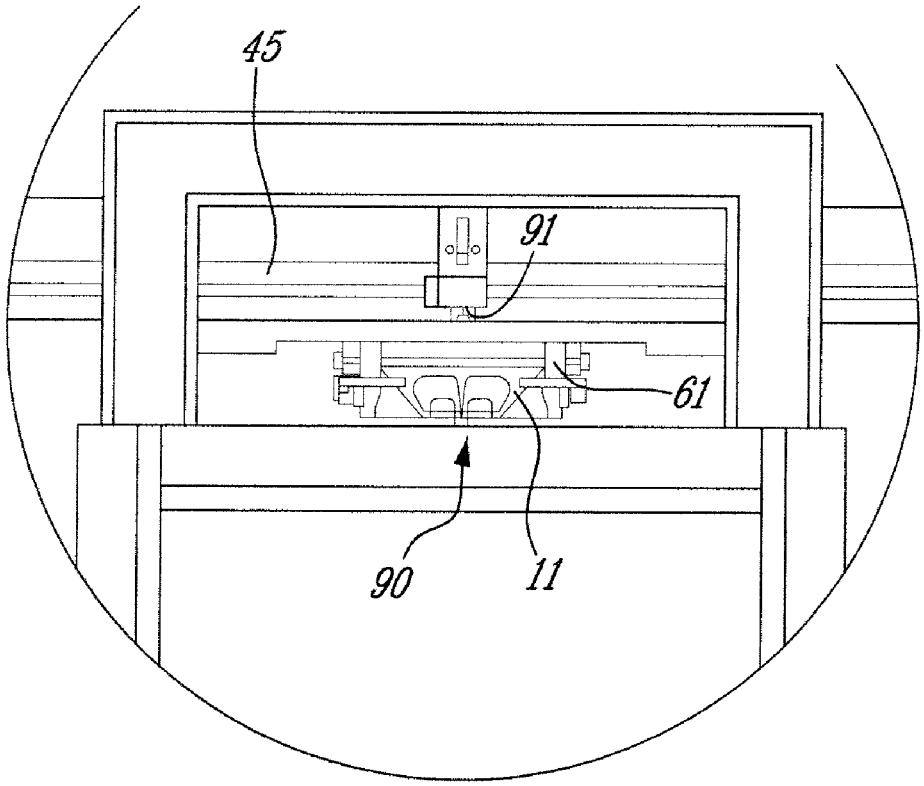
FIG. 10 is a top view showing a handle disposed in a dead nest where the handle is picked up by the gripping fingers to be transported to the handle securing station.

Referring again to FIG. 5, it can be seen that the handle 11 has a handle grip 38 defining a hand passage 39 thereunder. It also has an integrally molded reinforced central rib 38' bridging the handle grip and the attachment channel 34. This central rib of the handle 11 is gripped by a transfer mechanism whereby to transfer the bag with the handle secured thereto from the handle securing station 30 to a bag accumulating magazine 40, as better shown in FIGS. 4 and 8B. The bag transfer means or mechanism is constituted by a motorized hand gripper assembly 41, as shown in FIG. 8A. The gripper assembly 41 and two pairs of articulated hands, 41' and 41", each having a pair of gripping fingers 42 and 43 and 41' and 43', respectively. These gripping fingers constitute a handle positioner while others of the gripping fingers engage the handle 11 from the handle securing station to pull the bag therefrom and re-orient the handle with the bag secured thereto in a position to deposit the handle with the bag depending therefrom in the bag accumulating magazine 40 constituted by opposed pairs of spaced-part upwardly inclined support pins 44 and 44', as shown in FIG. 8B. The gripping fingers 43 grip the central rib 38' of the handle 11 to position the handle, with the bag depending therefrom, onto one set of the support pins 44 or 44' with the pins extending through the handle passages 39 formed on opposed sides of the central rib 38'. While the bag is deposited in the magazine another pair of gripping fingers retrieves a handle from a nest 61 of the handle conveyor 45, as shown in FIG. 10.

Bags are accumulated onto the support pins until a predetermined number of bags has been deposited in the magazine as detected by the controller whereby to form a bag bundle. The motorized hand gripper assembly 41 moves back and forth on a displaceable support between a handle supply conveyor 45, positioned elevated above the bag accumulating magazine 40 and the handle securing station 30. The pairs of gripping fingers 41' and 42" are secured to an articulated connection, not shown, while the gripping fingers are depositing a bag into the bag accumulating magazine 40, the other pair picks up a handle 11 from the handle supply track or conveyor 45, in a manner as will be described later. When the motorized hand gripper assembly moves to the handle securing station 30, the gripping fingers position the handle at a precise location within a nest under the welder horn, after the bag is removed therefrom by other gripping fingers, with the attachment channel 34 of the handle facing the support table 37 and ready to receive another leading edge of a further bag thereinto.

Figure 9:
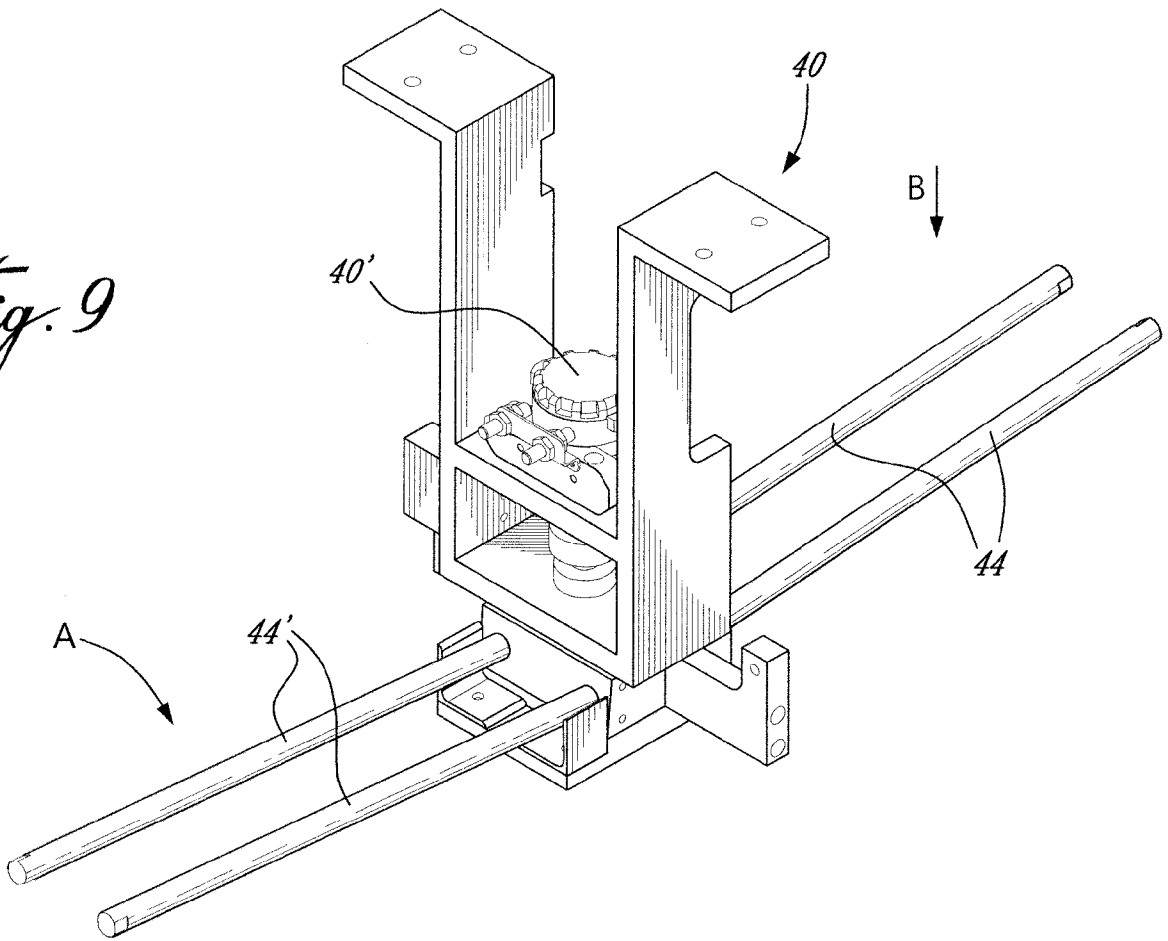
FIG. 9 is a perspective view of the bag accumulating and transfer magazine.
Figure 11:
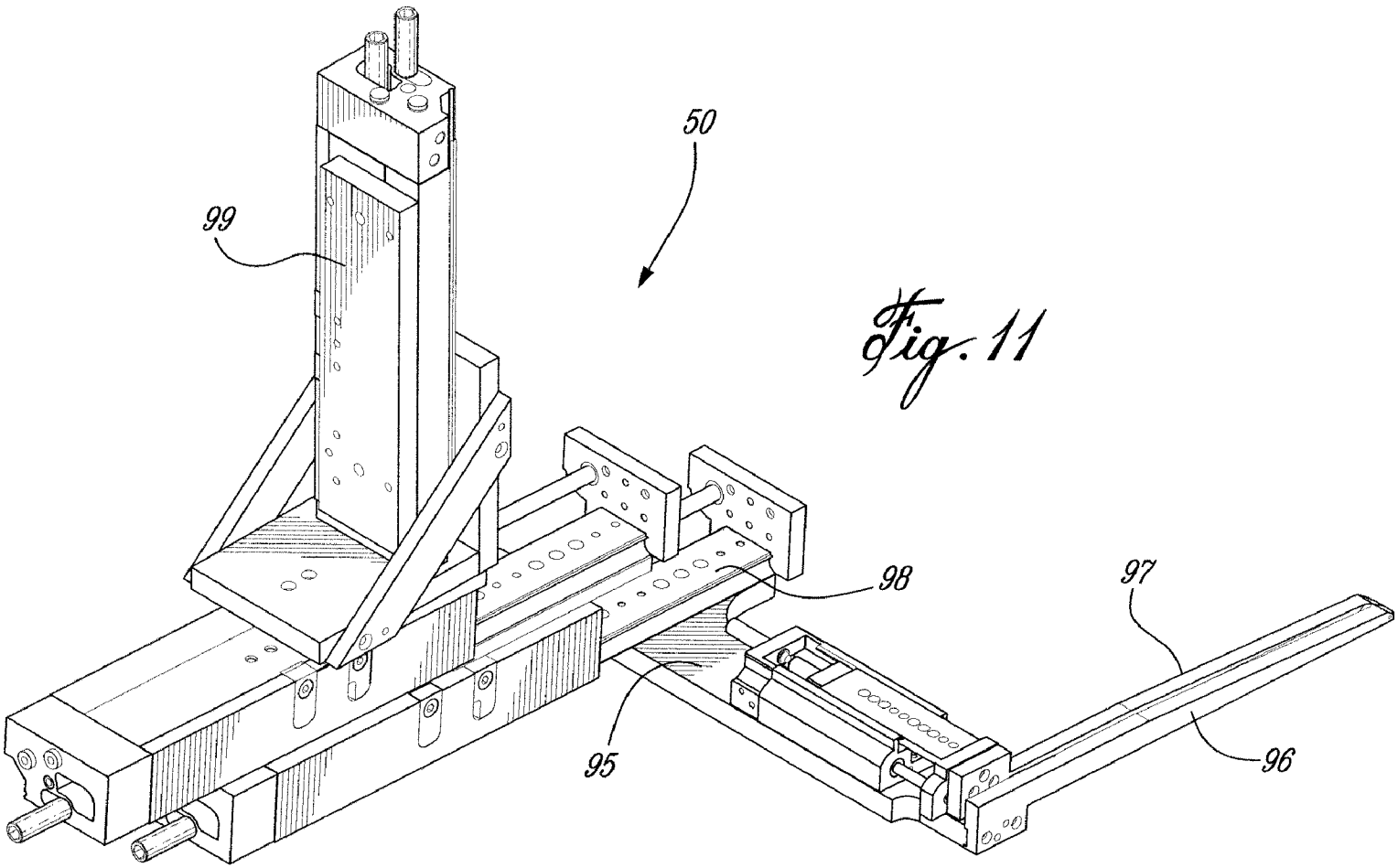
FIG. 11 is a perspective view of the bag bundle retrieving and transporting mechanism.

As shown in FIG. 9, the bag accumulating magazine 40 has two displaceable magazine sections A and B. One of the magazine sections is positioned at a bag receiving and accumulating position, namely as illustrated by the position of section A and the other section B is positioned at a bag bundle discharge position, as shown in FIG. 4, whereat a bag bundle retrieving and transporting mechanism, herein a gantry 50, as shown in FIG. 11, picks up accumulated bags from the magazine at a discharge position, as illustrated by section B, to transfer the bundle to a securing machine 51 located at the end of a support rail 52 on which the carriage 53 of the bag bundle retrieving mechanism 50 is displaced. A bundle securing machine 51, herein constituted by a strapping machine, well known in the art, positions a strap through the hand passages 39 of the accumulated handles 11 of the bundle whereby to secure the bundle for packaging and shipping on the outfeed conveyor 54.

As shown in FIG. 11, the gantry 50 has an arm 95 to which projects a pair of fingers, namely a static finger 96 and a sliding finger 97 which separate to enter respectively the hand passages 39 of handles 11 of the accumulated bag bundle and close to clamp the handles, whereafter the fingers are displaced to lift and retract the arm 95 and therefore the bundle from the pair of pins 44. The arm 95 is secured to a cylinder operated support 98. The monitoring plate 99 is secured to a carriage 53 displaceable on support rack 52, see FIG. 1.

It is pointed out that the computer of the controller can be programmed for retrieving bags of different sizes settings as set in the memory of its computer. The program of the computer accommodates a range of bag sizes from 10 to 20 inches wide and 20 to 30 inches long. The system is set up and calibrated based upon a master bag of known dimensions. In order to set up subsequent bag size to be handled by the system, the user simply enters the bag dimensions into an interface module of the computer and the computer calculates the differences in dimensions between the master bag specifications stored in the memory and feeds these offsets to the robot to adjust to the desired bag size to be processed. Based on these parameters, the controller automatically adapts the system to handle different sizes and different kinds of bags, as selected by the user. The computer is also provided with vision software and monitors all of the cameras of the system. A monitoring keyboard for troubleshooting, not shown, is provided at a convenient location.

Figure 12:
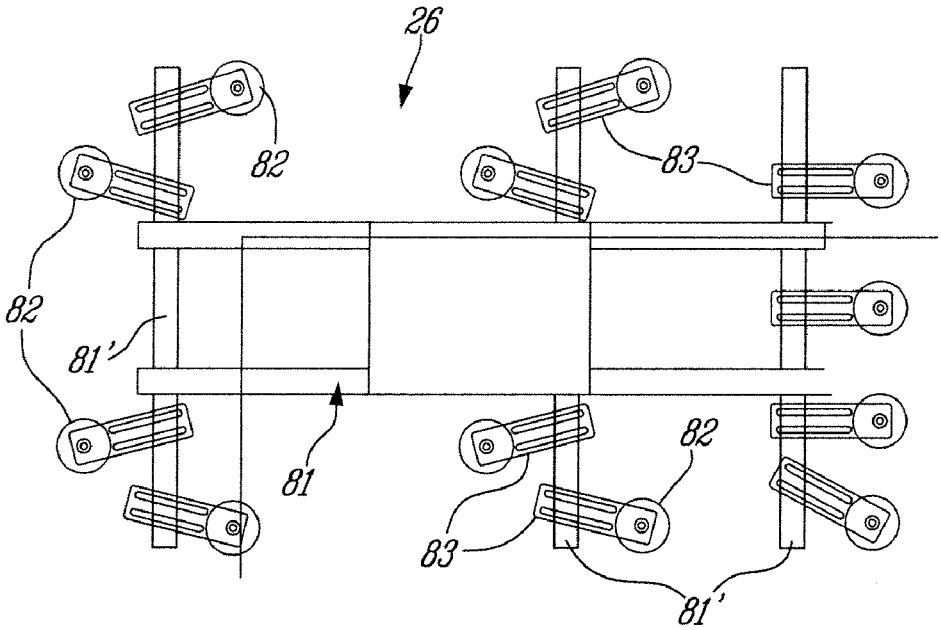
FIG. 12 is a perspective view illustrating the construction of the orientable bag engaging handle of the robot showing the adjustable suction cups.

Referring to FIG. 12 there is shown the construction of the bag-engaging hand which is connected to the articulated arm 27 by an articulated coupling 80, as shown in FIG. 4, controlled by the controller. The bag-engaging hand 26 has a planar support frame 81 to which is displaceably secured a plurality of suction cups 82. The suction cups 82 are mounted on adjustable supports 83 whereby to displace and position the support cups within a predetermined area of the support frame cross-arms 81. The frame is constructed such as to support sufficient suction cups to accommodate bags of different sizes. Vacuum is provided to only those suction cups 83 which are dedicated to engage bags of the size placed on the delivery conveyor 20. The suction cups 83 are spaced whereby to engage a top one of the bags only with two cups being placed close to the leading edge of the bag whereby to maintain this leading edge as taut as possible for positioning within the channel 34 of the handle 11.

The fine-tuning camera 31 as shown in FIG. 7A provides accurate positioning of the bag within the weld tolerances as stored in the computer's memory. The robot 23 brings the bag underneath the fine positioning camera 31 and by doing so triggers the camera and the controller receives data on the bag position as it is in motion. The camera 31 looks for the edge 16' of the bag adjacent the perforated profile, as previously mentioned, as well as the points at which the edges of the handle contact the top of the bag. The camera then sends X-Y signal data to the robot. Since the top of the bag is not perfectly straight, the vision system only focuses on where the edge of the handle contacts the bag and aims to make the skew or gap less than 1 mm tolerance at these two points. If the offset values are outside the safe limits for the robot to place the bag onto the table, the robot rejects the bag into the chute 32" or a bin in front of the table, as previously described. Both cameras 28 and 31 need to be calibrated when installed whereby they are positioned at an exact position. To do so, each tracking camera uses three engraved lines 55 for calibration. The lines are engraved on the side of the delivery conveyor 20 located directly under the camera. The mark lines 55 are within the camera field of view, see FIG. 1.

The camera 28 is a line tracking camera and it takes pictures every 100 mm of conveyor travel. Once the camera finds the bag entering the bag transfer station 24, it determines its location and passes the data to the robot. The robot picks the bag based on the location of the trailing edge of the bag since it knows its location from the data supplied by the camera as well as the bag dimensions as stored in the computer's memory. The robot is controlled to target the theoretical center point of the bag and picks up the top bag off the moving conveyor. As the robot transfers the bag to the bag support table 37, the computer checks inputting signals to determine if the welder horn is up, if a perforator is installed adjacent the welder horn if the spout perforations are to be punched in the bags being processed. It also checks if a new handle is placed in the nest of the welding assembly to receive the bag and if the bag clamping mechanism is up before the robot moves into final position to place the bag onto the table. Before the robot shuts the vacuum to the suction cups of the bag engaging hand 26 to release the engaged bag, it triggers the holding clamps 35 which are provided with rubber plungers to hold the bag in position within the handle channel during the welding process. These clamps 35 remain engaged until the ultrasonic welder starts welding. As soon as the clamps are engaged the robot releases the bag and begins to move back to get the next bag from the next group of bags being conveyed into its bag transfer station 24. This action triggers the welder and the perforator if such is provided at the station.

After the welding operation is completed and the welder horn has retracted, the sensor 36 inspects the welded bag and handle to verify that the position of the welded handle is within acceptable tolerances. If the finished bag does not pass inspection, the robot removes the bag and discharges it for recycling, as above described. If multiple bags have failed in a row at the same weld station, then the weld station is automatically shut down by the controller but the other stations and their robots remain operative. An accumulating bin 56 is provided at the end of the conveyor to accumulate excess bags on the delivery conveyor due to a shortage of one robot.

The bag accumulating magazine 40, shown in FIG. 8B, is a carousel system adapted to receive finished bags from the welding station and hold them until a bundle of a predetermined bag quantity is collected. Each of the bag transfer stations is provided with this carousel which is displaceable on a rotary actuator 40' 180° from a bag accumulating position to a bundle discharge position. The two sections A and B allow the system to keep running as one section of the carousel is always being loaded. The carousel is controlled and monitored by the controller. Before the carousel is displaced from its bag receiving position to its bundle discharge position, the controller verifies that the bundle retrieval mechanism is not in the station zone and then it rotates the carousel to position the bag bundle for gripping by the retrieval mechanism. As soon as the carousel is rotated, the controller sends a signal to the motorized hand gripper assembly. The carousel will usually wait until a full bag bundle is removed before it can rotate again. To avoid all the lanes becoming full with bag bundles at once and overloading the bag bundle retrieving mechanism 50, the filling of the carousel may be staggered. This is done by prematurely indexing some carousels with less than the predetermined number of bags required for a complete bundle. For example, the controller may choose to index a particular carousel prematurely, say with twelve (12) bags instead of 25. This presents a fresh set of support pins 44 to the hand gripper assembly. Once the motorized hand gripper assembly has loaded twenty-five bags onto the support pins 44, the carousel will index again. This will position the twenty-five bags at the discharge position and bring the twelve bags back to the loading position to continue loading. This provides for a balanced work load for the bag bundle gantry retrieving mechanism 50 and this is all controlled by the controller.

As previously described, handles 11 are supplied by a handle supply track conveyor 45. At the inlet of the handle supply track conveyor 45 there is provided, as shown in FIG. 1, a bowl feeder 60. The bowl feeder 60 is a rotary unit and is able to achieve a feed rate sufficient to supply handles to the four robots as shown in the system of FIG. 1. The bowl feeder is a device known in the art and it is adapted to supply the track conveyor 45 to distribute handles to the robot welding stations. The track conveyor 45 has four presentation points 90, only one shown in FIG. 10, along its length, one for each bag transfer station. These presentation points 90 have a stop cylinder 91 to singulate and separate individual handles 11. A push cylinder 91 transfers the individual handles into a dead nest 61 for the motorized hand gripper assembly and more specifically the gripper fingers to pick up the nested handle. When a handle is positioned in the dead nest 61 a signal is sent to the controller to indicate that the handle is ready for pick-up. After the handle is picked up, the handle supply track 45 cycles again and readies a new handle for pick-up.

As previously described, there are rejects during the operation of each of the bag transfer stations. In fact, there are three rejection locations in the system from the point where the bag is transferred from the delivery conveyor 20 to its positioning in the carousel. The first reject location is at the end of the delivery conveyor 20 where the bin 56 is provided. The second reject station is between the table 37 at the handle securing station 30 and the delivery conveyor 20. A third reject location is provided between the handle securing station and the carousel wherein the motorized hand gripper assembly 41 has the capability to reject finished bags if the bag does not pass post-welding inspection.

Figure 13:
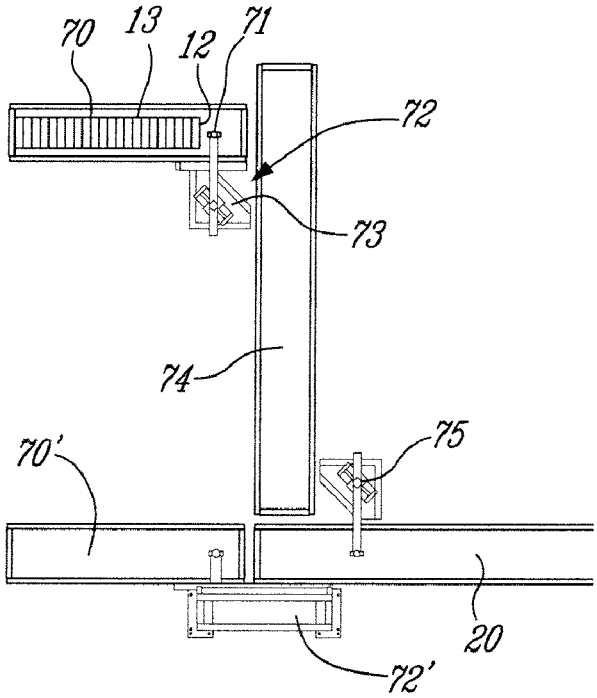
FIG. 13 is a top view of an infeed conveyor system which orients bags fed in a continuous shingle arrangement from a bag former and re-orients these bags in groups of four and transfers them to the conveyor of the automatic handle attaching system of the present invention.

Referring now to FIG. 13, there will be described the supply front end of the system. As shown, a feed conveyor 70 on which there is conveyed a supply of plastic bags 13 in a shingled arrangement to feed the bags to the system. The bags are placed one on top of the other and offset at the leading edge, herein with an offset overlap of three inches. These bags are printed and have a sealed top edge and an open bottom end. A sensor 71 is located above the belt conveyor 70 and detects the leading edge 12 of the first bag and initiates the cycle start of a linear bag separator 72. The linear bag separator 72 is provided with a gripper assembly 73 which has suction cups and which is lowered to touch the bags to be picked up. To feed the system of the present invention the bags must be grouped in groups of four bags and accordingly the suction cups will pick up four of the leading bags, or more, if there are more robots 23 in the system and transfer them on an intermediate belt conveyor 74. The linear bag separator then turns 90 degrees and the suction to the suction cups is removed whereby the four bags still in an overlap condition are released onto the intermediate belt conveyor to form a shingled group of four bags. Another linear bag separator 75 operates in the same fashion to transfer the groups of four bags onto the delivery conveyor 20 to feed the automatic handle attaching system 10 of the present invention. It is also pointed out that there can be an alternate path if another bag forming machine is used to supply shingled bags on conveyor 70' located directly in front of conveyor 20. Another linear bag separator 72' transfers those bags onto conveyor 20 in synchronism with the linear bag separator 75.

Briefly summarizing the method of operation of the automatic handle attaching system of the present invention, it consists essentially of the steps of conveying on a delivery conveyor a plurality of spaced-apart groups of plastic bags. Each group contains a predetermined number of bags in a flat form disposed one on top of the other and offset along a leading straight edge thereof. The straight edges of the bags are oriented approximately transverse to a conveying direction of the delivery conveyor. A camera detects the orientation and position of a top one of the bags as they are conveyed into the transfer stations. During the displacement of the bag groups along the delivery conveyor, the bags may be subjected to slight displacement. The method further comprises engaging the top one of the bags by a bag engaging hand of a robot which is automatically oriented to be co-incident with the detected orientation and position of the top one of the bags. The bag engaging hand is provided with suction cups to engage the top bag only and then to transfer the top bag to a handle securing station 30 with the leading straight edge thereof disposed at a precise location relative to the plastic handle retained at the handle securing station. The bag is precisely positioned with respect to the handle disposed in the nest of the ultrasonic welder. The handle is welded and a sensor verifies that the handle is at a proper position with respect to a corner of the bag which is then transferred by the motorized hand gripper assembly to discharge the bag in a carousel and at the same time pick up another handle from the handle supply track conveyor. The motorized hand gripper then returns to the handle securing station to remove the bag with the welded handle and position a new handle within the nest while the robot has retrieved a bag from the conveyor 20 which is now ready to be repositioned into the handle.

Once the carousel is filled with a predetermined quantity of bags the controller will transfer these bags to a retrieval position where the bag bundle retrieving gantry mechanism will transfer the assembled bundle for strapping and delivery to an outfeed conveyor.

As illustrated there are four bag handling and transfer stations 24 but additional ones can be added to increase the output of the system.

It is within the ambit of the present invention to cover any obvious modifications of the preferred embodiment described herein provided such modifications fall within the scope of the appended claims.

We claim:

1. An automatic handle attaching system for precisely securing a plastic handle on an edge of a preformed plastic bag, said system comprising a delivery conveyor for conveying spaced-apart groups of flat plastic bags, each group of bags having two or more bags disposed one on top of the other and offset along a leading straight edge thereof oriented approximately transverse to a conveying direction of said conveyor, two or more automated bag handling mechanisms are disposed spaced-apart adjacent said delivery conveyor at respective bag transfer stations, each said bag handling mechanism being independently operated and having an orientable bag engaging hand secured to an articulated arm, detection means at each said bag transfer station to detect the orientation and position of a top one of said bags of one of said groups at said bag transfer stations, control means to position said bag engaging hand to engage said top one of said bags at its associated bag transfer station as said groups of bags are conveyed by said conveyor, said articulated arm displacing bag engaging hand to position said leading straight edge of said bag at a precise location at a handle securing station having bag position detection means and handle attachment means, and means to transfer said bag with said handle secured thereto and to position a further handle in said handle attachment means at said handle securing station.

2. An automatic handle attaching system as claimed in claim 1 wherein said detection means is a camera secured above said delivery conveyor at each said bag transfer station, said camera providing data to said control means to analyze the orientation and displacement of said top one of said bags of said groups of bags and to operate said bag articulated arm to position said bag engaging hand at a position corresponding to the detected orientation of said top one of said bags and onto said top one of said bag and engage same.

3. An automatic handle attaching system as claimed in claim 2 wherein said control means is a programmable controller having a computer provided with a memory in which is stored executable instructions, said computer analyzing said data and when said data indicates that said top one of said bags is positioned partly outside said perimeter area, causing said articulated arm and said bag engaging hand to transfer said top one of said bags to a recycling position where it is released, said computer controlling the speed of said conveyor.

4. An automatic handle attaching system as claimed in claim 2 wherein said bag position detection means is a fine-tuning camera secured above a bag support means at said handle securing station, a handle position sensor associated with said handle securing station to detect the position of a handle secured to said leading straight edge of said bag, said fine-tuning camera providing data to said control means to position said leading straight edge of said bag at a precise location relative to an attachment portion of said handle held at said handle securing station.

5. An automatic handle attaching system as claimed in claim 4 wherein said bag support means is a welder table, said handle position sensor feeding signals to said controller to verify that said handle is secured at a position within a programmed tolerance spacing relative to a side edge of said bag as stored in said memory, said controller operating said articulated arm to position said bag engaging hand with said bag having said handle secured thereto to a bag recycling position to reject said bag when said handle is welded to said bag outside said programmed tolerance spacing.

6. An automatic handle attaching system as claimed in claim 4 wherein said fine-tuning camera provides data to said controller for a precise alignment of said bag by precise positioning of said bag engaging hand relative to a corner of said bag at said leading straight edge with respect to said handle attachment means.

7. An automatic handle attaching system as claimed in claim 6 wherein said attachment portion of said handle is a straight attachment channel portion of said handle defined between a pair of integrally formed flaps, said bag engaging hand positioning said leading straight edge of said bag into said straight attachment channel edge portion.

8. An automatic handle attaching system as claimed in claim 7 wherein there is further provided clamping means to hold said bag leading straight edge immovable in said channel portion of said handle, said handle being held immovable in a nest formation below said handle attachment means.

9. An automatic handle attaching system as claimed in claim 6 wherein said plastic bag is provided with a perforated spout profile in said corner of said bag, said handle being secured in a central region of said bag along said leading straight edge and spaced a predetermined distance from said perforated spout profile.

10. An automatic handle attaching system as claimed in claim 9 wherein said handle attachment means is an ultrasonic welding device to secure said plastic handle in a central region of said bag along said leading straight edge.

11. An automatic handle attaching system as claimed in claim 4 wherein there is further provided a transfer means to transfer bags with a handle secured thereto from said handle securing station to a bag accumulating magazine.

12. An automatic handle attaching system as claimed in claim 11 wherein said transfer means further comprises a handle positioner to transfer a handle from a handle support to a handle nesting formation associated with said bag support station and said handle securing mechanism.

13. An automatic handle attaching system as claimed in claim 12 wherein said transfer means is a motorized hand gripper assembly having two pairs of articulated hands having gripping fingers, one of said pair of gripping fingers constituting said handle positioner, the other of said pair of gripping fingers engaging said handle from said handle securing station and pulling said bag secured thereto from said bag support means and re-orienting said handle with said bag secured thereto to deposit said handle in a handle support of said bag accumulating magazine with said attached bag depending from said handle.

14. An automatic handle attaching system as claimed in claim 13 wherein said bag accumulating magazine has two displaceable magazine sections, one said magazine section being positioned at a bag receiving and accumulating position, the other of said magazine sections being positioned at a bag bundle discharge position.

15. An automatic handle attaching system as claimed in claim 14 wherein there is further provided a bag bundle retrieving and transporting mechanism to pick up accumulated bags at said bag bundle discharge position of said bag accumulating magazine and transfer them to a bundle securing machine where said bag bundle is secured for packaging and shipping.

16. An automatic handle attaching system as claimed in claim 13 wherein said handle support is constituted by a pair of spaced-apart upwardly inclined support pins, said handle having a handle grip with a hand passage thereunder, said support pins extending through said hand passage in said handle grip.

17. An automatic handle attaching system as claimed in claim 16 wherein said handle grip is provided with an integrally molded central rib depending therefrom and extending across said hand passage, said other of said pair of gripping fingers engaging said central rib at said handle securing station, said pair of upwardly inclined support pins extending through said hand passage with each pin of said pair extending through a respective one of opposed sides of said central rib to maintain said bags in substantially facial alignment to form said bundle.

18. An automatic handle attaching system as claimed in claim 1 wherein said orientable bag engaging hand has a planar frame provided with a plurality of suction cups displaceably secured thereto to position said suction cups at predetermined positions to engage said top one of said bags of said groups of bags at predetermined locations, said frame being articulatingly connected to said articulated arm.

19. An automatic handle attaching system as claimed in claim 18 wherein said bag handling mechanism is a computer controlled robot.

20. An automatic handle attaching system as claimed in claim 1 wherein said groups of preformed plastic bags are formed in a bag forming machine disposed at a forward end of said delivery conveyor, said groups being formed by a transfer arm engaging a predetermined number of bags from a series of conveyed bags overlapped in a shingled arrangement, and transferring same on said conveyor in a continuous uninterrupted manner, said bags having an open trailing end formed between a front and rear wall of said plastic bags, said bags having printed matter thereon.

* * * * *